US007234431B2

(12) United States Patent
Adam et al.

(10) Patent No.: US 7,234,431 B2
(45) Date of Patent: Jun. 26, 2007

(54) STARTER DEVICE FOR AN INTERNAL COMBUSTION ENGINE

(75) Inventors: Roland Adam, Besigheim (DE); Markus Keller, Löhnberg (DE); Stefan Kummermehr, Waiblingen (DE); Heiko Pinkawa, Waiblingen (DE); Jens Kern, Waiblingen (DE); Reinhard Friedrich, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/936,542

(22) Filed: Sep. 9, 2004

(65) Prior Publication Data

US 2005/0051127 A1 Mar. 10, 2005

(30) Foreign Application Priority Data

Sep. 9, 2003 (DE) ..... 103 41 462

(51) Int. Cl.
*F02N 1/00* (2006.01)

(52) U.S. Cl. ..... 123/185.14; 123/185.3

(58) Field of Classification Search ..... 123/185.14, 123/185.2, 185.3, 185.4
See application file for complete search history.

(56) References Cited

U.S. PATENT DOCUMENTS 3,763,842 A * 10/1973 Dooley et al. ..... 123/185.14
6,508,220 B1 1/2003 Akaike et al.
2002/0121258 A1* 9/2002 Nieda et al. ..... 123/185.14

FOREIGN PATENT DOCUMENTS

JP 2003-42041 A * 2/2003

* cited by examiner

*Primary Examiner*—Stephen K. Cronin
(74) *Attorney, Agent, or Firm*—Walter Ottesen

(57) ABSTRACT

A starter device (1) for an internal combustion engine has a starter drum (4) which acts upon a spring housing (11) when starting. An intermediate spring (10) is arranged in the spring housing (11). One end of the intermediate spring (10) is fixed to the spring housing (11) and the other end of the intermediate spring (10) can be coupled to the crankshaft (3) of the engine via a first catch (23). The spring housing (11) and the starter drum (4) are journalled on a shaft (7) held at one end. The center of gravity (S) of the spring housing (11) lies in the region of the support of the spring housing (11) in order to reduce the acting bearing forces and to increase the service life of the starter device.

28 Claims, 4 Drawing Sheets

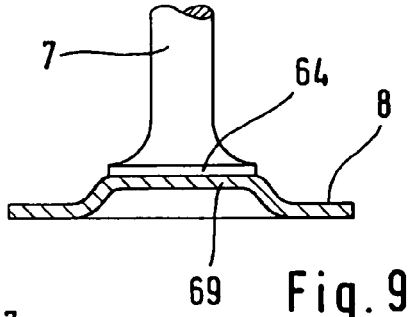
Fig. 9
Fig. 10
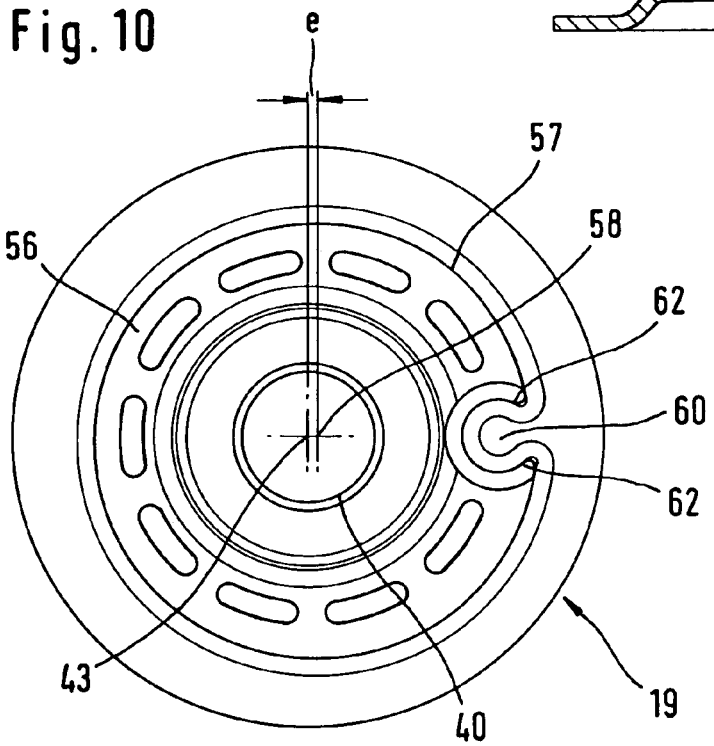
Fig. 11
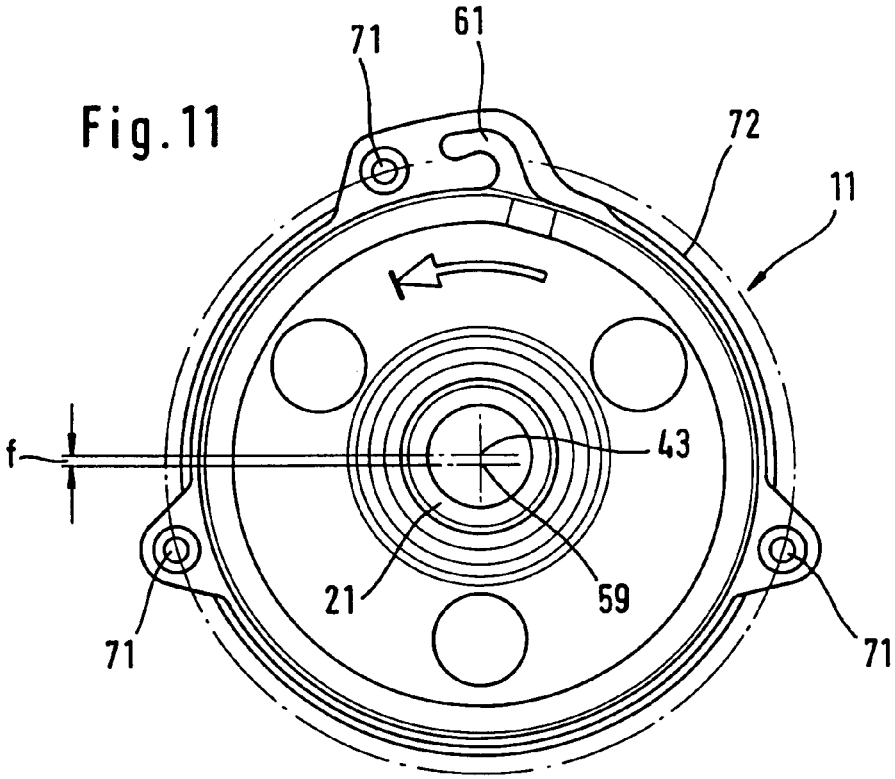

STARTER DEVICE FOR AN INTERNAL COMBUSTION ENGINE

CROSS REFERENCE TO RELATED APPLICATION

This application claims priority of German patent application no. 103 41 462.2, filed Sep. 9, 2003, the entire content of which is incorporated herein by reference.

FIELD OF THE INVENTION

The invention relates to a starter device for an internal combustion engine including a portable handheld work apparatus such as a motor-driven chain saw, blower apparatus or the like.

BACKGROUND OF THE INVENTION

U.S. Pat. No. 6,508,220 discloses a starter device for an internal combustion engine wherein the starter drum acts on the spring housing of an intermediate spring. The spring housing and the starter drum are journalled on a shaft supported on one side. The support is arranged in the region of the starter drum. A collar of the spring housing projects through the starter drum. The spring housing is journalled on the collar. During operation of the engine, the starter drum is at standstill in the housing. The housing of the intermediate spring is decoupled from the crankshaft via the catch; however, the spring housing rotates with the crankshaft because of the high rpm thereof. In this way, comparatively high rpms can be reached. This leads to high bearing forces which must be taken up by the shaft clamped at one end. The forces developing during operation lead to a malfunction of the spring starter which thereby has only a short service life.

SUMMARY OF THE INVENTION

It is an object of the invention to provide a starter device of the kind described above which is simple with respect to its configuration and has a long service life.

The starter device of the invention is for an internal combustion engine having a crankshaft defining a rotational axis. The starter device includes: a holding structure; a shaft held at one end thereof in the holding structure; a spring housing having a center of gravity (S); a spring arranged in the spring housing and having first and second ends; a starter drum for acting on the spring housing when the starter drum is actuated; the starter drum being rotatably journalled on the shaft; the spring being connected to the spring housing at the first end thereof; a catch for coupling the second end of the spring to the crankshaft; and, the spring housing and the shaft conjointly defining a support interface whereat the spring housing is supported on the shaft and the center of gravity (S) is in the region of the support interface.

The forces, which act on the bearing of the spring housing, are reduced because the center of gravity of the spring housing is arranged in the region of the support thereof. The service life of the bearing is increased. Likewise, the forces, which act on the shaft, are reduced. In this way, an increase of the service life of the starter device is achieved with a simple configuration.

Advantageously, the spring housing is supported by a needle bearing. In this way, a small structural size of the total starter device can be achieved. The spring housing has a free-running element and the support of the spring housing and the free-running element are separated spatially from each other. The free-running element ensures that the spring housing cannot automatically rotate back after a starter stroke. The support of the spring housing and of the free-running element are advantageously arranged one next to the other in the axial direction. In this way, a compact configuration with a simultaneous separation of functions can be achieved.

The shaft is held on the housing part. A good fixation of the shaft can be achieved when the base of the shaft is injection molded to the housing part. At the same time, a simple way of manufacture results because no additional work step is necessary to attach the shaft. In order to achieve a fixation of the base, which withstands high operating forces, the base is configured to have a plate-like shape and to have recesses. The material of the housing part can penetrate the recesses when applied so that a good anchoring of the base on the housing part can be achieved. With the plate-shaped configuration, the bending torque, which acts on the shaft, can be taken up in an excellent manner.

A simple strong connection of the base and shaft is achieved when the shaft is soldered to the base. The shaft has an enlarged diameter at the end facing toward the base. In this way, a higher strength of the shaft at the highly loaded base point results. Advantageously, the base includes a slot which is formed so as to peripherally extend about the shaft. In this way, tension peaks at the base point are reduced. A good connection of the base to the shaft can be achieved in that the base has a bore into which a lug of the shaft projects. The lug is pressed into the bore. The base has a pedestal on which the shaft is mounted. However, it can be practical that the base has a collar having an opening through which the shaft is passed from the side facing away from the starter drum.

The spring housing is balanced about a center axis which is at a distance relative to the rotational axis of the spring housing. This defined imbalance is compensated by the built-in intermediate spring so that, in this way, the spring housing with the intermediate spring is balanced about the rotational axis. Balancing is possible in a simple manner because only the spring housing is balanced. The spring housing has a cover which holds the intermediate spring in the spring housing in the axial direction. In this way, a fixing of the intermediate spring in the spring housing is achieved in a simple manner.

The intermediate spring has a second end which is fixed to an entrainer on which the first catch operates. The intermediate spring is advantageously a spiral spring which is advantageously held at its second end in a receptacle in the entrainer. The receptacle is axially aligned and closed by the cover. In this way, a simple assembly of the intermediate spring can be achieved. At the same time, the receptacle can be produced in a simple manner. It is provided that the receptacle has an undercut or backcut at which the intermediate spring is held. In this way, a reliable fixing of the intermediate spring results. Advantageously, the intermediate spring is wound on a strut on the entrainer. In order to achieve a high service life of the intermediate spring, it is provided that the center axis of the periphery of the strut is at a distance to the rotational axis. Because of the distance, the bending of the intermediate spring at the strut can be reduced in the region of the exit from the receptacle so that the loading of the intermediate spring is reduced and the service life thereof is increased.

The entrainer can be configured as a separate component. The entrainer is then advantageously rotatably journalled on a shoulder of the spring housing.

The starter drum acts advantageously on the spring housing via a second catch. The pawls of the second catch are arranged on the starter drum. The spring housing is held on the shaft in the axial direction by the entrainer. In this way, a simple configuration of the starter device results. The entrainer as well as the spring housing are reliably held by the holder of the entrainer. A simple configuration results when the spring housing lies against a shoulder of the shaft on the side facing away from the entrainer. The entrainer is advantageously held via a holding ring on the shaft. The starter drum is held on the shaft by a holding element. In this way, an axial configuration of the entire arrangement is obtained which ensures a simple configuration and a simple assembly. Only a few holding elements are needed for holding the entire configuration.

BRIEF DESCRIPTION OF THE DRAWINGS

The invention will now be described with reference to the drawings wherein:

FIGS. 6 to 9 show section views of the connection of the shaft to the base;

FIG. 10 is a plan view of the entrainer from the side facing toward the spring housing; and, FIG. 11 is a plan view of the spring housing viewed from the side of the entrainer.

DESCRIPTION OF THE PREFERRED EMBODIMENTS OF THE INVENTION

Figure 1:
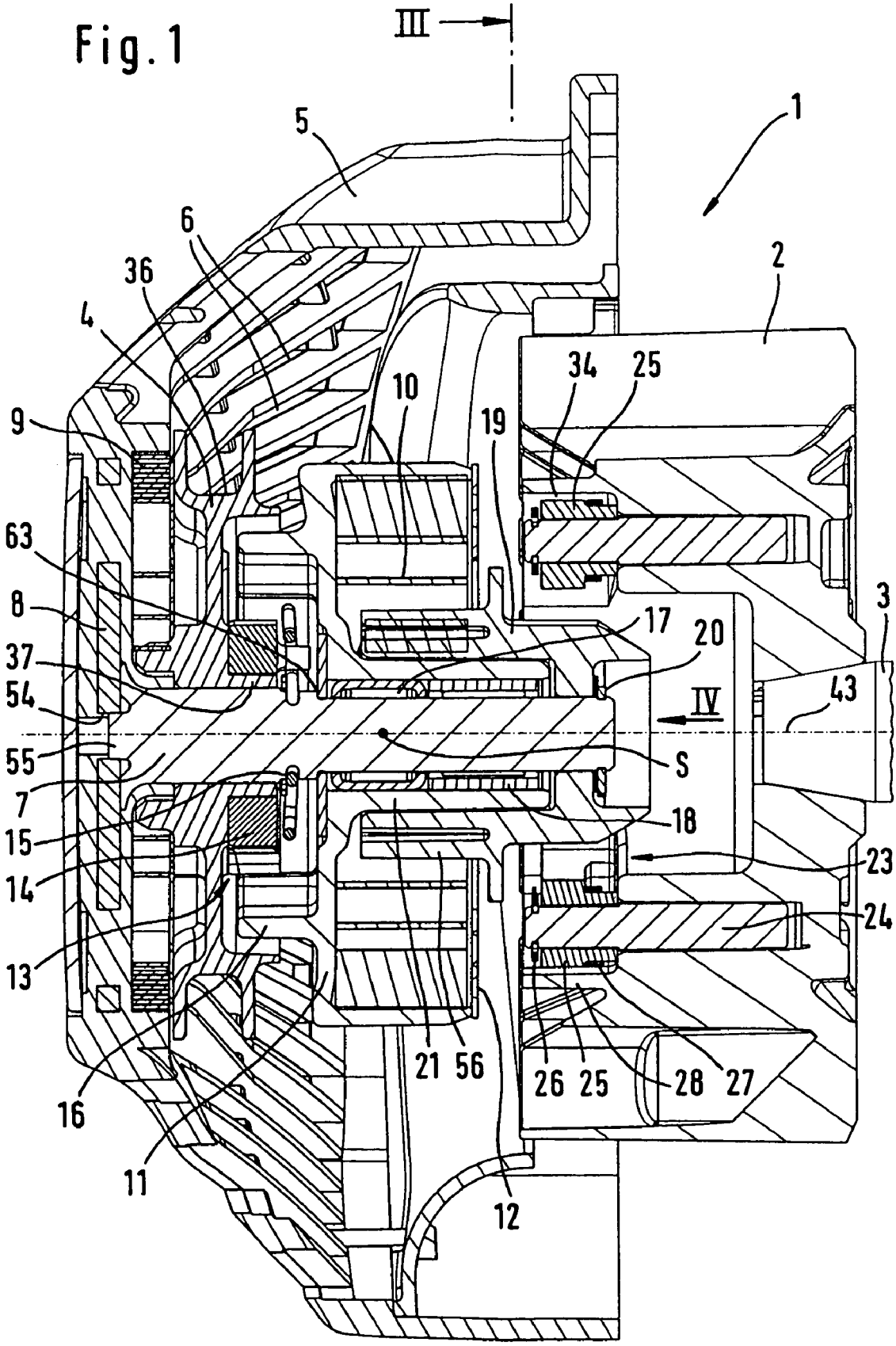
FIG. 1 is a section view taken through a starter device according to the invention.

The starter device 1 shown in section in FIG. 1 functions to drive the crankshaft 3 of an internal combustion engine including the internal combustion engine of a portable handheld work apparatus such as a motor-driven chain saw, cutoff machine or the like. The starter device 1 has a starter drum 4 with a peripherally-extending slot 36 on which a starter rope (not shown in FIG. 1) is wound. The starter drum 4 is held via a return spring 9 to a housing cover 5 of the work apparatus. The return spring 9 is configured as a spiral spring. A shaft 7 is fixed to the housing cover 5 and the starter drum 4 is rotatably journalled on this shaft. The shaft 7 has a lug 55 which projects into a bore 54 in the base 8 of the shaft 7.

The base 8 of the shaft 7 is injection molded on the housing cover 5. A spring housing 11 is rotatably journalled on the shaft 7 by a needle bearing 17 and a free-running element 18. The spring housing 11 has an edge 16 on the side thereof facing toward the starter drum 4. The edge or collar 16 of the spring housing 11 projects into an edge on the starter drum 4. In this way, a labyrinth-like gap is formed between the two components. This gap substantially prevents a penetration of dirt to a second catch 13. The starter drum 4 can be coupled to the spring housing 11 via the second catch 13. The second catch 13 includes pawls 14 which are pivotally journalled on the starter drum 4. The pawls 14 are secured by a guide clip 15 in the direction of the rotational axis 43 of the starter drum 4 and of the spring housing 11. The pawls 14 are mounted radially outside of a hub 37 of the starter drum 4. This hub separates the pawls 14 from the shaft 7. The starter drum 4 is fixed on the shaft 7 in the direction of the rotational axis 43 by guide clip 15.

The spring housing 11 includes a shoulder 21 on which the spring housing 11 is supported on the shaft 7. The needle bearing 17 is arranged in the region of the gravity center S of the spring housing 11. The gravity center S advantageously lies in the direction of the rotational axis 43 in the region between the end faces of the needle bearing 17, especially approximately in the geometric center point of the needle bearing 17. The free-running element 18 is mounted on the side, which faces away from the starter drum 4, next to the needle bearing 17 in the direction of the rotational axis 43 so that the bearing and the free-running element are spatially separated from each other. The spring housing 11 lies on a shoulder 63 of the shaft 7 on the side facing toward the starter drum 4. An entrainer 19 is rotatably journalled on the periphery of the shoulder 21. An intermediate spring 10 is mounted in the spring housing 11 and is configured as a spiral spring. The first end of the intermediate spring 10 is fixed to the spring housing 11. The second end of the intermediate spring 10 is held in portion 56 of the entrainer 19.

The intermediate spring 10 winds itself about the portion 56 of the entrainer 19 when tensioning. The entrainer 19 is held by a holding ring 20 on the shaft 7 on the side facing away from the spring housing 11. The portion 56 of the entrainer 19 engages over the shoulder 21 of the spring housing 11 and holds the spring housing 11 in the direction of the rotational axis 43. In this way, a large support area is provided for the spring housing 11 as well as for the entrainer 19 so that the occurring bearing forces are low. Because of the interengaging configuration, only a holding ring for holding the spring housing 11 and entrainer 19 is necessary.

A first catch 23 engages the entrainer 19. The pawls 25 of the first catch 23 are held on a fan wheel 2 of the engine by bearing bolts 24. The fan wheel 2 is fixedly connected to the crankshaft 3 of the engine so as to rotate therewith. In the housing cover 5, vent openings 6 are provided through which the fan wheel 2 moves cooling air to the engine. The pawls 25 of the first catch 23 are fixed by holding rings 26 to the bearing bolts 24. The pawls 25 are spring supported by spiral springs 27 in the direction toward the entrainer 19. A gap 34 is formed between the pawls 25 and a peripherally-extending wall 28 of the fan wheel 2. On the side facing toward the entrainer 19 and the fan wheel 2, the spring housing 11 is closed by a cover 12 which is stamped from sheet metal and which holds the intermediate spring 10 in the spring housing 11 in the direction of the rotational axis 43.

When actuating the starter device, the starter rope is pulled out from the work apparatus. In this way, rotation is imparted to the starter drum 4 and the pawls 14 of the second catch 13 are pressed outwardly because of the centrifugal force and connect the starter drum 4 to the spring housing 11 so that the spring housing rotates therewith. In this way, the intermediate spring 10 is tensioned. The intermediate spring, in turn, operates on the crankshaft 3 via the entrainer 19 and the pawls 25 of the first catch 23. Insofar as the tension of the intermediate spring 10 is sufficient, the crankshaft 3 can already be rotated. With an increasing compression, that is, when the piston of the engine approaches top dead center, the resistance of the piston overcomes the force of spring 10 so that the intermediate spring is further tensioned. After ending the first starter stroke, the starter drum 4 is rotated by the return spring 9 in the opposite direction and the starter rope is wound in the peripheral slot 36. Because of the free-running element 18, the spring housing 11 remains at its position so that the intermediate spring 10 cannot relax. With the next starter stroke, the intermediate spring 10 is further tensioned. As soon as the force of the intermediate spring 10 is sufficient in order to move the piston of the engine beyond top dead center, the resistance becomes less and the intermediate spring 10 drives the crankshaft farther.

The engine need not be already started with one starter stroke; instead, several starter strokes can be used which sufficiently tension the intermediate spring. For this reason, the force needed to start the engine is small.

Figure 2:
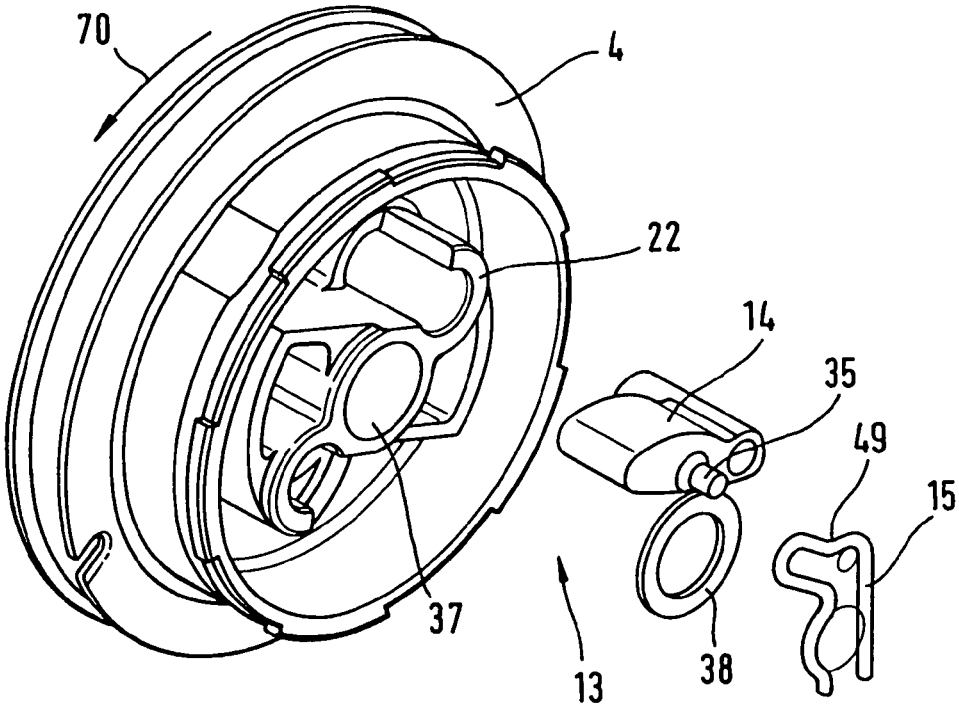
FIG. 2 is an exploded view of a second catch.

In FIG. 2, the second catch 13 is shown in an exploded perspective view. The pawls 14 of the second catch 13 are journalled on a wall 22 of the second catch. The wall partially encloses the pawls 14 in the region of the support. The pawls 14 are held in the axial direction by a washer 38 which is held on the shaft 7 by a guide clip 15. The pawls 14 have a bolt 35 which is guided in the guide clip 15. The guide clip 15 includes a bend 49. After overcoming a starter resistance which is effected by the bend 49, the pawls 14 can pivot outwardly. This takes place as soon as the starter drum 4 has reached a specific rotational speed. The starter drum 4 is rotated in the rotational direction 70. The pawls 14 hook onto projections (not shown) on the collar or edge 16 of the spring housing 11 and so connect the starter drum 4 form-tightly to the spring housing 11.

Figure 3:
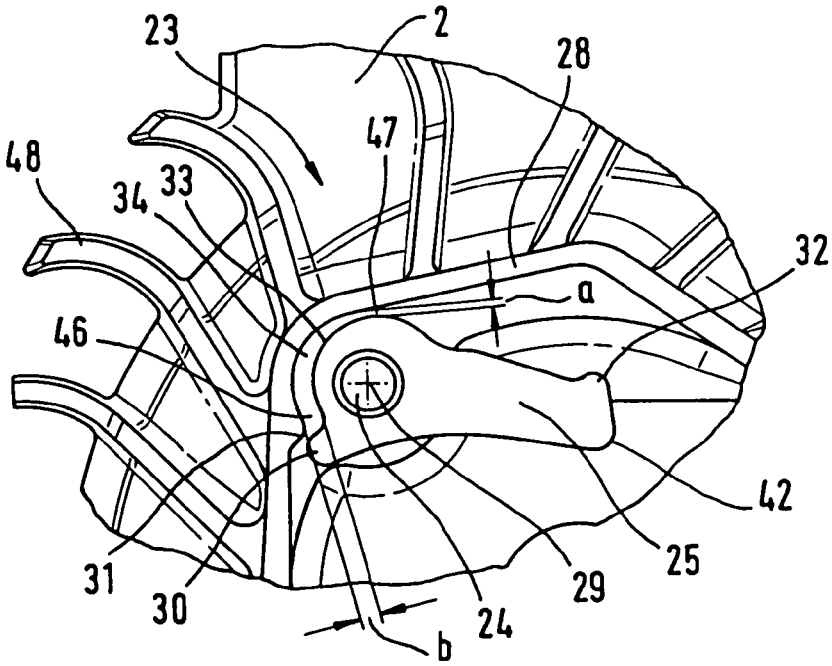
FIG. 3 is a detailed view of the first catch viewed in the direction of arrow III of FIG. 1.

FIG. 3 shows a side elevation view of the first catch 23. The pawls 25 of the first catch 23 are arranged within a wall 28 which extends from the fan wheel 2 in the axial direction toward the spring housing 11. The wall 28 separates the pawls 25 from the vanes 48 of the fan wheel 2. The pawls 25 are pivotally journalled about the bearing bolts 24 about a rotational axis 29. The pawls 25 each have a lug 30 which coacts with a first stop 31 formed on the wall 28 and fixes the position of the pawls in which the pawls are completely pivoted inwardly. On the opposite-lying end, the pawls 25 have a second stop 32 which coacts with the wall 28 and defines the position of the pawls 25 pressed outwardly. A gap 34 is formed between the outer walls 33 of the pawls 25 in the region of the bearing bolts 24 and the wall 28. The gap 34 has a width (b) at its first end 46 facing toward the stop 31 and has a width (a) on its second opposite-lying end 47. The wall 33 of the pawl 25 is formed elliptically in the region of the bearing bolt 24. When pivoting the pawl 25 from the position shown in FIG. 3 outwardly, the gap 34 becomes smaller so that dirt, which can collect in the gap 34, is compressed by the pawl 25 and pressed outwardly. In this way, a plugging of the gap 34 with dirt and a negative effect on the function of the first catch 23 is avoided.

Figure 4:
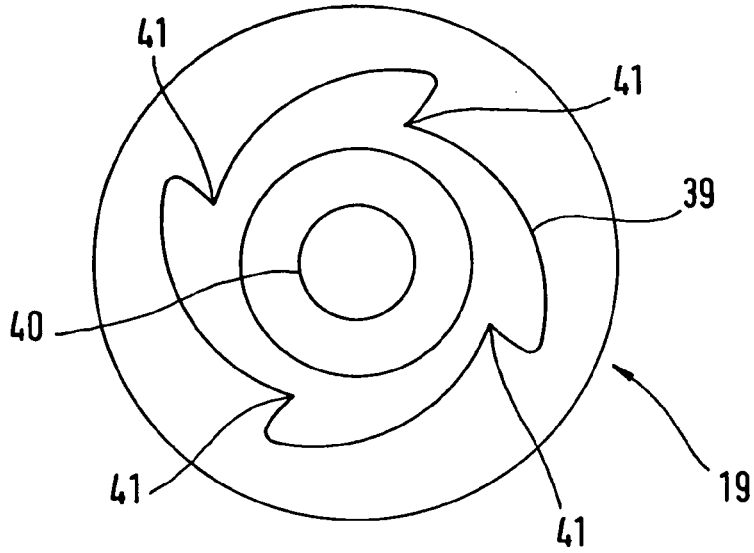
FIG. 4 is a side elevation view of the entrainer viewed in the direction of arrow IV of FIG. 1.

FIG. 4 is a plan view of the entrainer 19 seen from the side facing toward the fan wheel 2. The entrainer 19 has a cam contour 39 which has four latch recesses 41. As shown in FIG. 3, a latch lug 42 is formed on the pawls 25 at the end facing away from the bearing bolts 24. For a non-rotated fan wheel 2, the latch lug 42 projects into a latch recess 41 of the entrainer 19 and so connects the entrainer 19 to the fan wheel 2 that they rotate with each other. At high rpms of the fan wheel 2, the pawls 25 are pressed outwardly because of the centrifugal force so that the pawls 25 release from the latch recesses 41 and decouple the fan wheel 2 from the entrainer 19. The entrainer 19 is configured as a separate component and is journalled on the shoulder 21 of the spring housing 11. The entrainer 19 has a bore 40 through which the shaft 7 projects. The inner diameter of the bore 40 is less than the inner diameter of the shoulder 21 of the spring housing 11 so that the spring housing 11 is fixed in axial direction by the entrainer 19.

Figure 5:
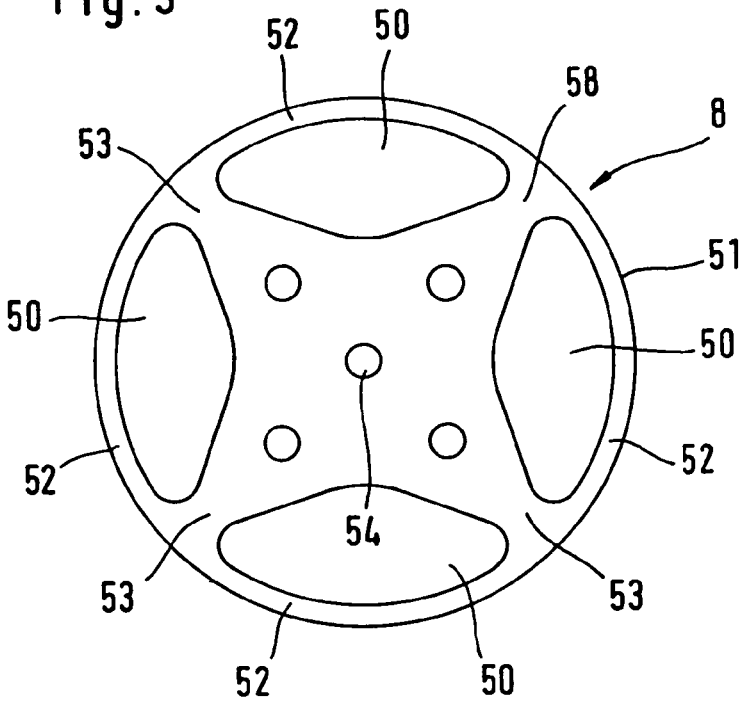
FIG. 5 is a side elevation view of the base.

FIG. 5 shows the base 8 of the shaft 7 in plan view. The base 8 is configured to have a plate-like shape and has a circular disc-shaped base plate with a center bore 54. The lug 55 of the shaft 7 projects through the bore 54. The base 8 has four recesses 50. The recesses 50 are at a distance to the outer periphery 51 of the base 8 so that an edge 52 is formed between the recesses 50 and the outer periphery 51. A spoke 53 is disposed between each two of the recesses 50. The spoke 53 extends from the region, which is arranged within the recesses 50, to the outer periphery 51. Material of the housing cover 5 can flow into the recesses 50 during application so that the base 8 is securely held in the housing cover 5. Bending loads, which occur at the shaft 7, can be well taken up because of the large outer periphery 51.

Figure 6:
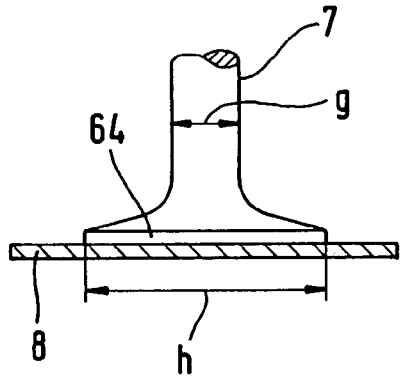

FIG. 6 shows an embodiment of the attachment of the shaft 7 to the base 8. The shaft 7 has a diameter (h) at its end 64 facing toward the base 8. This diameter (h) is greater than the diameter (g) of the shaft 7. The shaft 7 is soldered to the base 8. Improved strength results because of the increased diameter in the region of the end 64.

Figure 7:
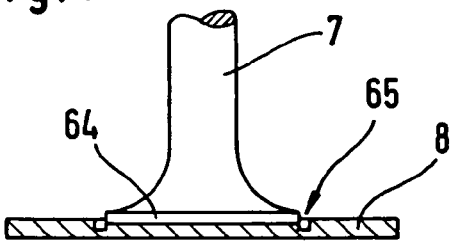

In the embodiment of FIG. 7, a slot 65 is arranged in the base 8 about the end 64. The slot 65 prevents tension peaks in the base 8.

Figure 8:
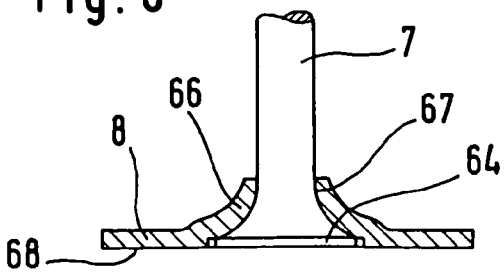

FIG. 8 shows a base 8 which has a collar 66. The collar 66 extends arcuately on the side facing toward the starter drum 4. The collar 66 has an opening 67 through which the shaft 7 is pushed from the side 68 facing away from the starter drum 4. The shaft 7 is held on the base 8 with its widened end 64. The shaft 7 is fixedly soldered to the base 8.

In the embodiment shown in FIG. 9, the base 8 has a pedestal 69 in the region of the shaft 7. The pedestal 69 is arcuate on the side facing toward the shaft 7. The shaft 7 is fixedly soldered to the pedestal 69 at its widened end 64. In the embodiment shown in FIG. 1, the shaft 7 projects with a lug 55 into a bore 54 in the base 8. In this embodiment too, the shaft 7 is soldered to the base 8.

FIG. 10 is an enlarged view of the entrainer 19 seen from the end projecting into the spring housing 11. The entrainer 19 has a portion 56 which is guided on the shoulder 21 of the spring housing 11 (FIG. 1). In the portion 56, a receptacle 60 is arranged for the second end of the intermediate spring 10. The receptacle 60 has an omega-shaped cross section. The wall of the receptacle 60 is configured as a part circle. In the region wherein the receptacle 60 goes over into the periphery 57 of the portion 56, undercuts 62 are formed on both sides of the receptacle 60. An eyelet formed on the intermediate spring 10 can be arranged in the receptacle 60. The eyelet is held in the receptacle 60 because of the undercuts 62. The periphery 57 of the portion 56 is bent about a center axis 58 eccentrically to the rotational axis 43. The center axis 58 is at a distance (e) to the rotational axis 43. For this reason, the intermediate spring 10 is guided flatter in the region adjacent the receptacle 60 and is therefore less subjected to load.

FIG. 11 is a side elevation view of the spring housing 11 wherein the cover 12 of the spring housing 11 is not shown. The spring housing 11 includes three bores 71 arranged on the outer periphery thereof whereat the cover 12 is held with threaded fasteners. A receptacle 61 is arranged next to the bore 71. The receptacle 61 extends outwardly with a hook shape from the inner space of the spring housing 11. The first end of the intermediate spring 10 is held in the receptacle 61. The cover 12 closes the receptacle 61 in the axial direction and thereby secures the intermediate spring 10 in the receptacle 61. The spring housing 11 is balanced about a center axis 59 which is at a distance (f) to the rotational axis 43. The center axis 59 is arranged on the side of the rotational axis 43 lying approximately opposite the receptacle 61. The shoulder 21 and the outer wall 72 of the spring housing 11 are arranged concentrically to the rotational axis 43. Because of the balancing of the spring housing 11 about the center axis 59, the unbalance, which is introduced by the intermediate spring 10, is compensated.

The first catch 23 includes two pawls 25 arranged one next to the other. However, another number of pawls 25 can be advantageous. For the second catch 13, one pawl 14 can be provided or two pawls 14 can be provided. Other numbers of pawls can also be practical.

It is understood that the foregoing description is that of the preferred embodiments of the invention and that various changes and modifications may be made thereto without departing from the spirit and scope of the invention as defined in the appended claims.

What is claimed is:

1. A starter device for an internal combustion engine having a crankshaft defining a rotational axis, the starter device comprising:

a holding structure;

a shaft held at one end thereof in said holding structure;

a spring housing having a center of gravity (S);

a spring arranged in said spring housing and having first and second ends;

a starter drum for acting on said spring housing when said starter drum is actuated;

said starter drum being rotatably journalled on said shaft;

said spring being connected to said spring housing at said first end thereof;

a catch for coupling said second end of said spring to said crankshaft; and, said spring housing and said shaft conjointly defining a support interface whereat said spring housing is supported on said shaft and said center of gravity (S) being in the region of said support interface so as to balance said spring housing with respect to said shaft.

2. The starter device of claim 1, further comprising a needle bearing arranged at said support interface for supporting said spring housing on said shaft.

3. The starter device of claim 2, wherein said spring housing includes a free-running element and said support interface and said free-running element are spatially separated from each other.

4. The starter device of claim 3, wherein said support interface and said free-running element are arranged next to each other in axial direction.

5. The starter device of claim 4, wherein said holding structure is a housing part.

6. The starter device of claim 5, further comprising a base for holding said shaft and said base being injection molded onto said housing part.

7. The starter device of claim 6, wherein said base is configured to have a plate-like shape and to have recesses formed thereon.

8. The starter device of claim 6, wherein said base has a slot configured to extend peripherally about said shaft.

9. The starter device of claim 6, wherein said base has a bore formed therein and said shaft has a lug formed thereon for projecting into said bore.

10. The starter device of claim 6, wherein said base has a pedestal and said shaft is mounted on said pedestal.

11. The starter device of claim 1, wherein said spring housing has a cover for holding said spring in the direction of said rotational axis.

12. The starter device of claim 1, wherein said catch is a first catch and said starter device further comprises a second catch for permitting said starter drum to act on said spring housing.

13. The starter device of claim 12, wherein said second catch has pawls mounted on said starter drum.

14. The starter device of claim 1, further comprising a retaining ring for holding said starter drum on said shaft.

15. The starter device of claim 1, further comprising an entrainer and said catch being arranged so as to act on said entrainer; and, said spring being fixed to said entrainer on said second end thereof.

16. The starter device of claim 15, wherein said spring housing is mounted on said shaft at an axial direction from said entrainer.

17. The starter device of claim 15, further comprising a retaining ring for holding said entrainer on said shaft.

18. The starter device of claim 15, wherein said spring is a spiral spring and said entrainer has a receptacle for holding said spiral spring at said second end thereof.

19. The starter device of claim 18, wherein said receptacle is an undercut in which said second end of said spiral spring is held.

20. The starter device of claim 15, wherein said entrainer has a web on which said spring is wound.

21. The starter device of claim 20, wherein said web has a periphery defining a center axis offset by a distance (e) from said rotational axis.

22. The starter device of claim 20, wherein said entrainer is configured as a separate component.

23. A starter device for an internal combustion engine having a crankshaft defining a rotational axis, the starter device comprising:

a holding structure;

a shaft held at one end thereof in said holding structure;

a spring housing having a center of gravity (S);

a spring arranged in said spring housing and having first and second ends;

a starter drum for acting on said spring housing when said starter drum is actuated;

said starter drum being rotatably journalled on said shaft;

said spring being connected to said spring housing at said first end thereof;

a catch for coupling said second end of said spring to said crankshaft;

said spring housing and said shaft conjointly defining a support interface whereat said spring housing is supported on said shaft and said center of gravity (S) being in the region of said support interface;

said holding structure being a housing part;

a base for holding said shaft and said base being injection molded onto said housing part; and, said shaft being soldered onto said base.

24. A starter device for an internal combustion engine having a crankshaft defining a rotational axis, the starter device comprising:

a holding structure;

a shaft held at one end thereof in said holding structure;

a spring housing having a center of gravity (S);

a spring arranged in said spring housing and having first and second ends;

a starter drum for acting on said spring housing when said starter drum is actuated;

said starter drum being rotatably journalled on said shaft;

said spring being connected to said spring, housing at said first end thereof;

a catch f or coupling said second end of said spring to said crankshaft;

said spring housing and said shaft conjointly defining a support interface whereat said spring housing is supported on said shaft and said center of gravity (S) being in the region of said support interface;

said holding structure being a housing part;

a base for holding said shaft and said base being injection molded onto said housing part; and, said shaft having an end portion facing toward said base and said end portion having an increased diameter.

25. The starter device of claim 24, wherein said base has a collar defining an opening; and, said shaft extends through said opening from the end of said base facing away from said starter drum.

26. A starter device for an internal combustion engine having a crankshaft defining a rotational axis, the starter device comprising:

a holding structure;

a shaft held at one end thereof in said holding structure;

a spring housing having a center of gravity (S);

a spring arranged in said spring housing and having first and second ends;

a starter drum for acting on said spring housing when said starter drum is actuated;

said starter drum being rotatably journalled on said shaft;

said spring being connected to said spring housing at said first end thereof;

a catch for coupling said second end of said spring to said crankshaft;

said spring housing and said shaft conjointly defining a support interface whereat said spring housing is supported on said shaft and said center of gravity (S) being in the region of said support interface so as to balance said spring housing with respect to said shaft;

an entrainer configured as a separate component;

said spring housing having a shoulder and said entrainer being rotatably journalled on said shoulder;

said catch being arranged so as to act on said entrainer; and, said spring being fixed to said entrainer at said second end thereof.

27. A starter device for an internal combustion engine having a crankshaft defining a rotational axis, the starter device comprising:

a holding structure;

a shaft held at one end thereof in said holding structure;

a spring housing having a center of gravity (S);

a spring configured to define an interior space and being arranged in said spring housing and having first and second ends;

a starter drum for acting on said spring housing when said starter drum is actuated;

said starter drum being rotatably journalled on said shaft;

said spring being connected to said spring housing at said first end thereof;

a catch for coupling said second end of said spring to said crankshaft;

said spring housing and said shaft conjointly defining a support interface whereat said spring housing is supported on said shaft and said center of gravity (S) being in the region of said support interface so as to balance said spring housing with respect to said shaft;

said spring housing including a shoulder for supporting said spring housing on said shaft; and, said shoulder projecting into said interior space defined by said spring.

28. A starter device for an internal combustion engine having a crankshaft defining a rotational axis, the starter device comprising:

a holding structure;

a shaft held at one end thereof in said holding structure;

a spring housing having a center of gravity (S);

a spring arranged in said spring housing and having first and second ends;

a starter drum for acting on said spring housing when said starter drum is actuated;

said starter drum being rotatably journalled on said shaft;

said spring being connected to said spring housing at said first end thereof;

said spring housing and said shaft conjointly defining a support interface whereat said spring housing is supported on said shaft and said center of gravity (S) being in the region of said support interface so as to balance said spring housing with respect to said shaft;

said spring housing including a shoulder for supporting said spring housing on said shaft;

an entrainer engaging over said shoulder and said second end of said spring being fixedly connected to said entrainer; and, a catch for releasably engaging said entrainer to thereby couple said second end of said spring to said crankshaft.

* * * * *